US009571923B2

(12) United States Patent
Spillmann et al.

(10) Patent No.: US 9,571,923 B2
(45) Date of Patent: Feb. 14, 2017

(54) ACOUSTIC WAVEGUIDE

(71) Applicant: Harman International Industries, Inc., Stamford, CT (US)

(72) Inventors: Jacques Spillmann, Los Angeles, CA (US); Steven Patrick Riemersma, Woodland Hills, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 52 days.

(21) Appl. No.: 14/599,869

(22) Filed: Jan. 19, 2015

(65) Prior Publication Data

US 2016/0212523 A1 Jul. 21, 2016

(51) Int. Cl.
*H04R 1/34* (2006.01)
*H04R 1/28* (2006.01)

(52) U.S. Cl.
CPC ..... *H04R 1/345* (2013.01); *H04R 1/2803* (2013.01)

(58) Field of Classification Search
CPC ..... H04R 1/345
USPC 181/152, 176, 177, 185, 187, 188; 381/340, 381/161
See application file for complete search history.

(56) References Cited

U.S. PATENT DOCUMENTS

| | | | | |
|---|---|---|---|---|
| 1,067,905 | A | 7/1913 | English | |
| 1,314,980 | A | 9/1919 | Pogonowski | |
| 1,525,320 | A | 2/1925 | Pierce | |
| 1,614,983 | A | 1/1927 | Fuller | |
| 1,639,048 | A | 8/1927 | Miessner | |
| 1,759,614 | A | 5/1930 | Hall | |
| 1,992,268 | A | 2/1935 | Wente | |
| 1,996,743 | A | 4/1935 | Blattner | |
| 2,001,089 | A | 5/1935 | Blattner | |
| 2,203,875 | A | 6/1940 | Olson | |
| 2,310,243 | A | 2/1943 | Klipsch | |
| 2,338,262 | A | 1/1944 | Salmon | |
| 2,537,141 | A | 1/1951 | Klipsch | |
| 3,957,134 | A * | 5/1976 | Daniel | G10K 11/30 181/176 |
| 3,980,829 | A | 9/1976 | Beveridge | |
| 4,091,891 | A | 5/1978 | Hino et al. | |
| 4,164,631 | A | 8/1979 | Garner | |

(Continued)

FOREIGN PATENT DOCUMENTS

EP 2001261 A1 12/2008

OTHER PUBLICATIONS

Urban, et al., Audio Engineering Society, Covention Paper 5488, Sep. 21-24, 2001, "Wavefront Sculpture Technology" (14 Pages).
Beranek, ISBN 0-88318-494-X, "Acoustics," pp. 268-276.

*Primary Examiner* — Jeremy Luks
(74) *Attorney, Agent, or Firm* — Brooks Kushman P.C.

(57) ABSTRACT

A high frequency waveguide and methods relating to the design and use of the waveguide are described. The waveguide can include an acoustic input to receive an audio input signal from a high frequency driver, an acoustic output to broadcast sound, and a plurality of acoustic paths extending from the input to the output. A first path of acoustic paths is divided into two paths when a width of the first path is greater than ½ wavelength of a highest frequency at the input. In an example, each of the plurality of acoustic paths carries across all frequencies from the high frequency driver. In an example, the paths each have a first port receiving audio and a second port outputting audio, and the paths enlarge from the first port to the second port.

22 Claims, 11 Drawing Sheets

(56) References Cited

U.S. PATENT DOCUMENTS

| | | | | |
|---|---|---|---|---|
| 4,187,926 | A | 2/1980 | Henricksen et al. | |
| 4,308,932 | A | 1/1982 | Keele, Jr. | |
| 4,344,504 | A | 8/1982 | Howze | |
| 4,390,078 | A | 6/1983 | Howze et al. | |
| 4,580,655 | A | 4/1986 | Keele, Jr. | |
| 5,020,630 | A | 6/1991 | Gunness | |
| 5,163,167 | A | 11/1992 | Heil | |
| 6,343,133 | B1 | 1/2002 | Adamson | |
| 6,394,223 | B1 | 5/2002 | Lehman | |
| 7,068,805 | B2 | 6/2006 | Geddes | |
| 7,278,513 | B2 | 10/2007 | Brawley, Jr. | |
| 7,631,724 | B2 | 12/2009 | Onishi | |
| 7,686,129 | B2 | 3/2010 | Delgado, Jr. | |
| 7,735,599 | B2 | 6/2010 | Kubota | |
| 7,953,238 | B1 | 5/2011 | Adams | |
| 8,224,001 | B1 | 7/2012 | Waller | |
| 8,607,922 | B1 * | 12/2013 | Werner | H04R 1/26 181/152 |
| 8,718,310 | B2 | 5/2014 | Adams | |
| 2002/0014368 | A1 * | 2/2002 | Adamson | G10K 11/22 181/182 |
| 2011/0274306 | A1 * | 11/2011 | Adams | H04R 1/30 381/338 |

* cited by examiner

ACOUSTIC WAVEGUIDE

TECHNICAL FIELD

Aspects as disclosed herein generally relate to acoustic waveguides, and more specifically to high frequency acoustic waveguides for loudspeakers.

BACKGROUND

In general multi-way loudspeaker systems are well known. Typical examples of multi-way loudspeaker systems include two-way loudspeakers and three-way loudspeakers. Generally, multi-way loudspeaker systems include multiple transducers (generally referred to as "loudspeakers," "speakers," "sound drivers," or "drivers") that operate at different frequency ranges. As an example, typical two-way loudspeakers include a low-frequency transducer and a high-frequency transducer, while typical three-way loudspeakers include a low-frequency transducer, a mid-frequency transducer (generally known as "midrange transducer" and "mid-range driver"), and a high-frequency transducer.

Enclosures and horns, such as those used with loudspeakers, are designed to control the radiating direction of sound. Sound radiating from sources, in the absence of an enclosure, may spread in uncontrolled directions.

Although there may be a need to change the angle of coverage of sound radiated from the loudspeaker, the shape of a horn and the loudspeaker enclosure fixes the sound coverage angle of a loudspeaker system. A user of a loudspeaker system may want to direct sound at an angle to reach an audience. Moreover, the user may want to direct the sound away from walls or architectural boundaries that cause wall reflections. The shape and design of the horn affects the sound reproduction from the loudspeaker. The horn should be design to evenly distribute the sound on a listening plane or curve and to reduce excess sound at undesired locations.

SUMMARY

A high frequency waveguide and methods relating to the design and use of the waveguide are described. The waveguide can include an acoustic input to receive an audio input signal from a high frequency driver, an acoustic output to broadcast sound, and a plurality of acoustic paths extending from the input to the output. A first path of acoustic paths is divided into two paths when a width of the first path is greater than ½ wavelength of a highest frequency at the input. In an example, each of the plurality of acoustic paths carries across all frequencies from the high frequency driver. In an example, the paths each have a first port receiving audio and a second port outputting audio, and the paths enlarge from the first port to the second port. In an example, outer walls define cross sectional area of the waveguide and exponentially diverge from the acoustic input to the acoustic output.

In an example, the acoustic paths do not recombine until the acoustic output.

In an example, the acoustic paths have a same length from the acoustic input to the acoustic output.

In an example, the acoustic paths are defined by smooth walls.

In an example, the acoustics paths are mirrored about central plane symmetry.

In an example, the acoustic paths have outlets at the acoustic output oriented to achieve a desired wavefront curvature.

In an example, the acoustic paths have unequal lengths to compensate for a non-isophase input signal at the acoustic input.

In an example, the acoustic paths have unequal widths to compensate for a non-isobel input signal at the acoustic input.

In an example, the acoustic paths are curved and defined by smooth walls.

The present disclosure also describes a speaker line array element that can have an elongate, high frequency waveguide including: at least two high frequency drivers; at least two acoustic inputs to receive an audio input signal from the high frequency drivers; an acoustic output to broadcast sound; and at least two sets of a plurality of acoustic paths extending from the inputs to the output, wherein a first path of acoustic paths of each set is divided into two paths when a width of the first path is greater than ½ wavelength of a highest frequency at the throat. The array element can also have sound integrators. In an example, a first sound integrator extends outwardly from a first side of the acoustic output, the first sound integrator including a plurality of first slots. A first mid-range speaker can be positioned behind the first sound integrator to output a mid-range acoustic signal through the first slots. In an example, a second sound integrator extends outwardly from a second side of the acoustic output, the second sound integrator including a plurality of second slots. A second mid-range speaker can be positioned behind the second sound integrator to output a mid-range acoustic through the second slots.

In an example, each of the plurality of acoustic paths carries across all frequencies from the high frequency driver.

In an example, the paths each have a first port receiving audio and a second port outputting audio, and the paths enlarge from the first port to the second port.

In an example, the outer walls define cross sectional area of the waveguide and exponentially diverge from the acoustic input to the acoustic output.

In an example, the acoustic paths do not recombine until the acoustic output.

In an example, the acoustic paths have a same length from the acoustic input to the acoustic output.

In an example, one of a set of acoustic paths is receives an acoustic signal from one of the drivers and the one set of the acoustics paths is mirrored about a central plane symmetry.

Methods are described of designing and fabricating the above structures. A method for a high frequency waveguide can include determining a rate of expansion for a high frequency waveguide, determining a number of acoustical paths for the waveguide with a dimension of the acoustical paths to be no greater than ½ wavelength of a highest frequency at an input, laying the acoustical paths in the waveguide; and when any acoustical path has a dimension greater than ½ wavelength of a highest frequency, inserting a dividing structure to divide the acoustic paths to maintain the limit on the dimension.

In an example, each of the steps is performed for a half of the waveguide and then a minor image of the half of the waveguide is constructed about a line of symmetry.

In an example, the rate of expansion is exponential.

In an example, the acoustic paths have outlets at the acoustic output oriented to achieve a desired wavefront curvature.

In an example, laying the acoustical paths includes compensating for a non-isophase input signal at the acoustic input by adjusting the acoustic paths to have unequal lengths; and In an example, laying the acoustical paths includes compensating for a non-isobel input signal at the acoustic input by adjusting the acoustic paths to have unequal widths.

In some examples, at least one acoustic path is asymmetric with respect to other acoustic paths about the center plane or other plane of symmetry.

DETAILED DESCRIPTION

Figure 1:
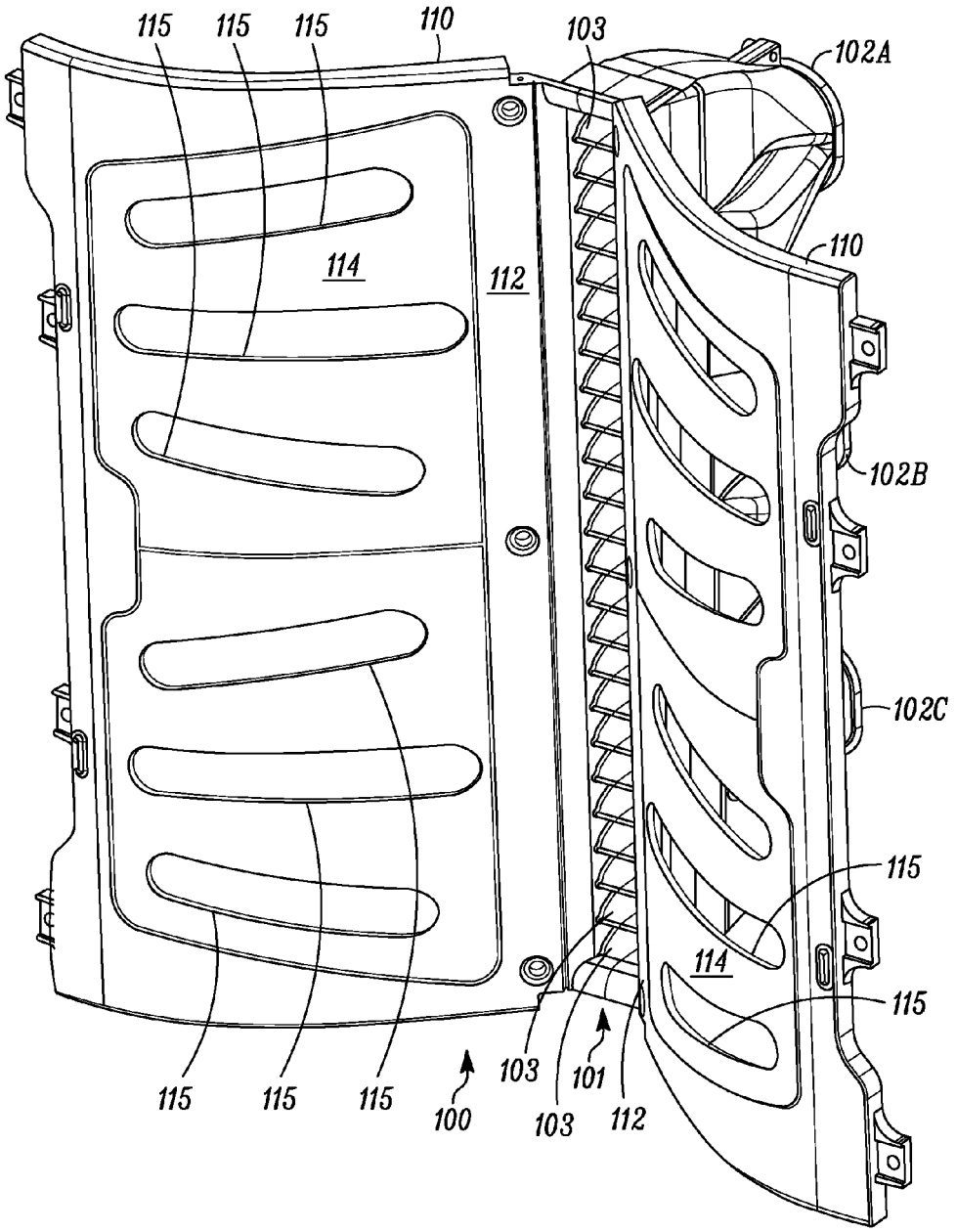
FIG. 1 is a view of a speaker assembly according to an embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

The present inventors have recognized some difficulties of combining multiple sound sources and having the sound sources emit the same acoustical content. When combining multiple sound sources the designer must attempt to evenly distribute sound on a listening plane and reduce excess sound emitted outside the listening plane, i.e. side lobes. There are several criteria, so-called Wavefront Sculpture Technology Criteria, used to describe conditions necessary to combine multiple sound sources in a variable-angle vertical array of loudspeakers. See e.g., "Wavefront Sculpture Technology", Urban, Heil and Bauman, Acoustic Engineering Society, Reprint #5488, 2001, which is hereby incorporated by reference. For high-frequency devices that are vertically spaced greater than a half a wavelength of the maximum operating frequency, the criteria states the wavefront emitted by the device should have a curvature less than one quarter the wavelength of the maximum operating frequency. Devices that do not satisfy the criteria result in unevenly distributed sound to the listening plane and excess sound emitted outside the listening plane.

In addition, the device used to create the wavefront must have a desired area expansion of the wavefront from the input to the output. The desired area expansion is related to the function:

$$S(x)=S_t*e^{(mx)}$$

This expansion maximizes the acoustic load to the source while minimizing the propagation distortion output of the source. See e.g., Acoustics, Leo L. Beranek, ISBN 0-88318-494-X, pp. 268 to 276, which is hereby incorporated by reference. A constant area is highly undesirable; although it presents a constant acoustic load to the source, it creates a high amount of propagation distortion. A constant expansion of area is also undesirable as it has reduced propagation distortion at the expense of poor acoustic loading of the sound source. A series of stepped, constant expansion areas can be used to approximate the desired area expansion function. However, true stepped expansion areas are undesirable as steps can create reflections, delays and interference in the acoustic path.

The present disclosure describes a method to design a structure that will allow the loudspeaker device to maintain a wavefront curvature of less than one quarter the wavelength of the maximum operating frequency. This will improve the ability of the loudspeaker to emit sound to the listening plane and reject noise going outside the listening plane. In addition, it allows the designer to specify the area expansion rate from the input of the structure to the exit of the structure. Thus the designer can specify the desired exponential rate of area expansion. The present disclosure also gives the designer a method for designing a device which emits a chosen non-isophase, non-isobel acoustic wavefront.

FIG. 1 shows a speaker assembly 100 with a vertically elongated waveguide 101 that operates to emit acoustical content that is received from an acoustic source. The waveguide 101 processes the acoustic signal and waves to induce curvature/time delay as the acoustic signal travels from the input side to the output side of the waveguide, right to left in FIG. 1. Acoustic sources can include high frequency drivers that convert an electrical signal to an acoustic wave signal. In the FIG. 1 embodiment, there are a plurality of acoustic inputs 102A, 102B and 102C that receive the acoustic signal from drivers (not shown in FIG. 1), respectively. A plurality of acoustic outputs 103 are on the output side of the waveguide 101. The acoustic outputs 103 are greater in number than the inputs 102. This requires that the acoustics paths in the waveguide 101 be divided as the waveguide progresses from the input side to the output side. The number of outputs 103 may be $2^N$ greater than the number of inputs 102, where N is greater than one. In an example, N is at least three such that each input 102 results in eight outputs 103.

The speaker assembly 100 includes flared structures 110 that can direct the acoustic output from the waveguide. The flared structures can operate as a bell to guide the sound from the waveguide output. The flared structures 110 can be removably positioned at the output side of the waveguide 101. In the illustrated embodiment of FIG. 1, the flared structures 110 can operate as sound integrators. The sound integrator structures 110 may be used to direct both mid-frequency and high frequency sound to predetermined areas, such as directly toward listeners or locations within a venue or an auditorium. The sound integrators 110 may send substantially the same quality sound to listeners located in different parts of a venue. The sound integrators 110 flare outwardly from the waveguide 101 and may be removably connected at the inner edge to a side of the waveguide 101. The waveguide 101 and sound integrators 110 may be fixed within a housing of the loudspeaker 100, but may also be removably connected to the housing. The sound integrators 110 include a leading section 112 forms a smooth transition to the outer surface 114 of the sound integrator 110. The sound integrators 110 are positioned adjacent to each other forming an angle relative to each other to function as a smooth wave-guide for the high frequency sound waves output from the waveguide outputs 103. The sound integrators 110 may by positioned at a predetermined angle to control a direction of the high frequency sound waves generated from a high frequency sound source(s), which can include the driver, associated electronics and waveguide 101.

The outer surface 114 of the sound integrators 110 may be shaped to project sound from a sound source at predetermined angles depending on the shape of the outer surface 114. The angular direction of the projected sound waves may be varied with the sound integrators 110 even though the shape of a loudspeaker enclosure remains fixed. In an example, sound is radiated from the loudspeaker 100 at an angle of about ninety degrees from the loudspeaker 100. In another example, sound integrators 110 may be used to control the projection of sound at an angle of about 120 degrees or 160 degrees.

Figure 2:
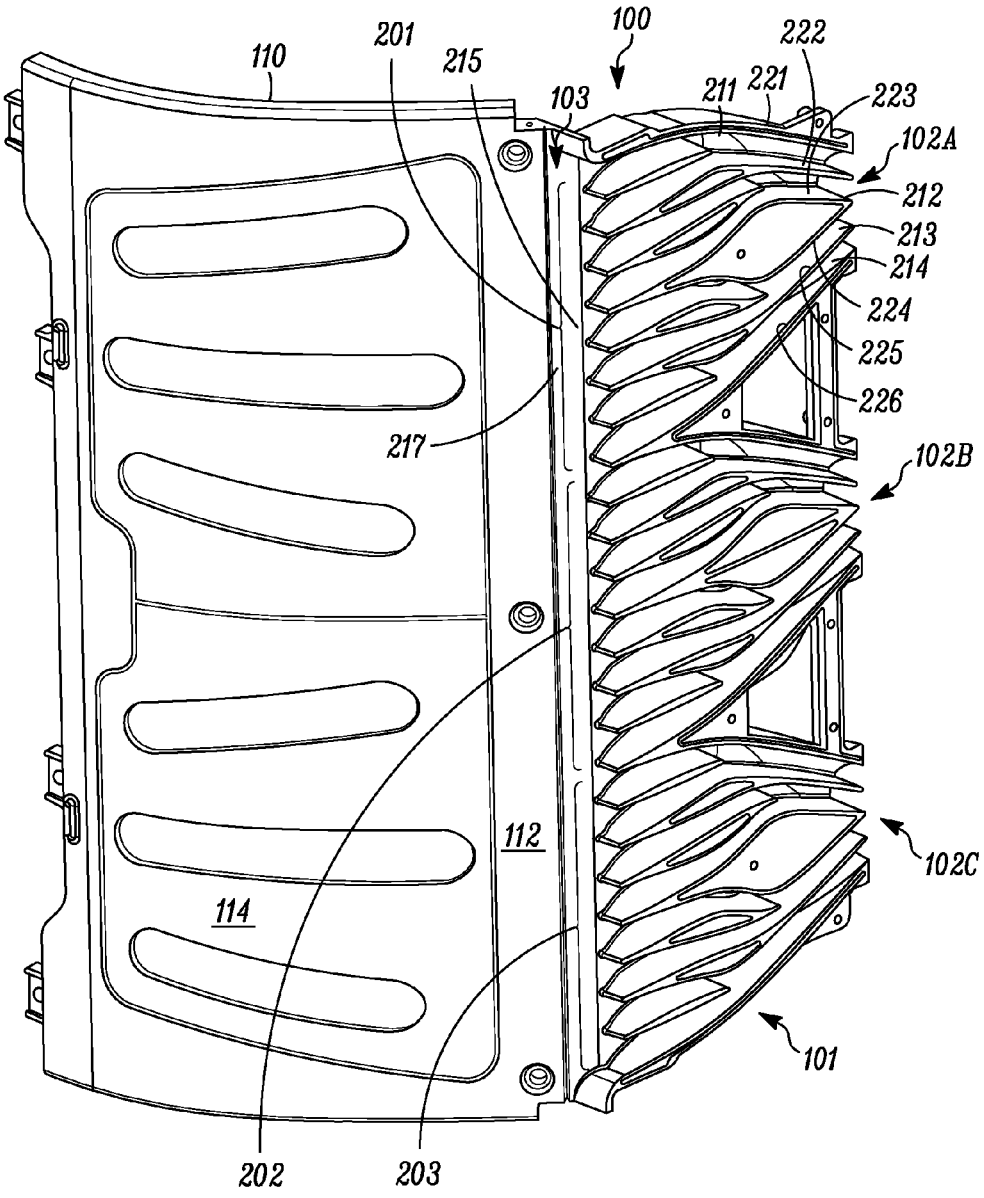
FIG. 2 is a view of half of the FIG. 1 speaker assembly according to an embodiment.

FIG. 2 shows the left half of the FIG. 1 speaker assembly 100 to illustrate the interior of the waveguide 101 and the plurality of acoustic paths from the inputs 102A-102C to the outputs 103. The other half of the speaker assembly 100 is a mirror image of FIG. 2 and can be fixed to the left half to form the complete, designed waveguide 101. The waveguide 101 is divided into sub-waveguides 201-203 that are each dedicated to a single one of the inputs 102A, 102B and 102C and, hence, to a single driver that outputs acoustic signals into the inputs 102A, 102B and 102C. Each of the sub-waveguides 201-203 is identical. Accordingly, the description will focus on the sub-waveguide 201 with the understanding that the other sub-waveguides 202 and 203 are identical to the sub-waveguide 201. However, the present disclosure is not so limited. In some embodiments, the sub-waveguides 201-203 may have different acoustic paths from other sub-waveguides. The input 102A is divided into four acoustic transmission paths 211-214, with paths 211 and 214 being on the outside and paths 212 and 213 being on the interior. Acoustic paths pairs 211, 214 and 212, 213 are minor images of each other along a center plane 215 of the sub-waveguide 201. That is, the acoustic paths 211 and 214 are the same but inverted relative to one another. The acoustic paths 212 and 213 are the same but inverted relative to one another. The acoustic paths 211-215 are defined by walls 221-226 in the body of the waveguide 101. All of the walls of the waveguide that define acoustic paths are smooth and continuous. The walls can be fabricated to have the shapes as described herein from polymers, metals, fibers, resins and the like.

Figure 3:
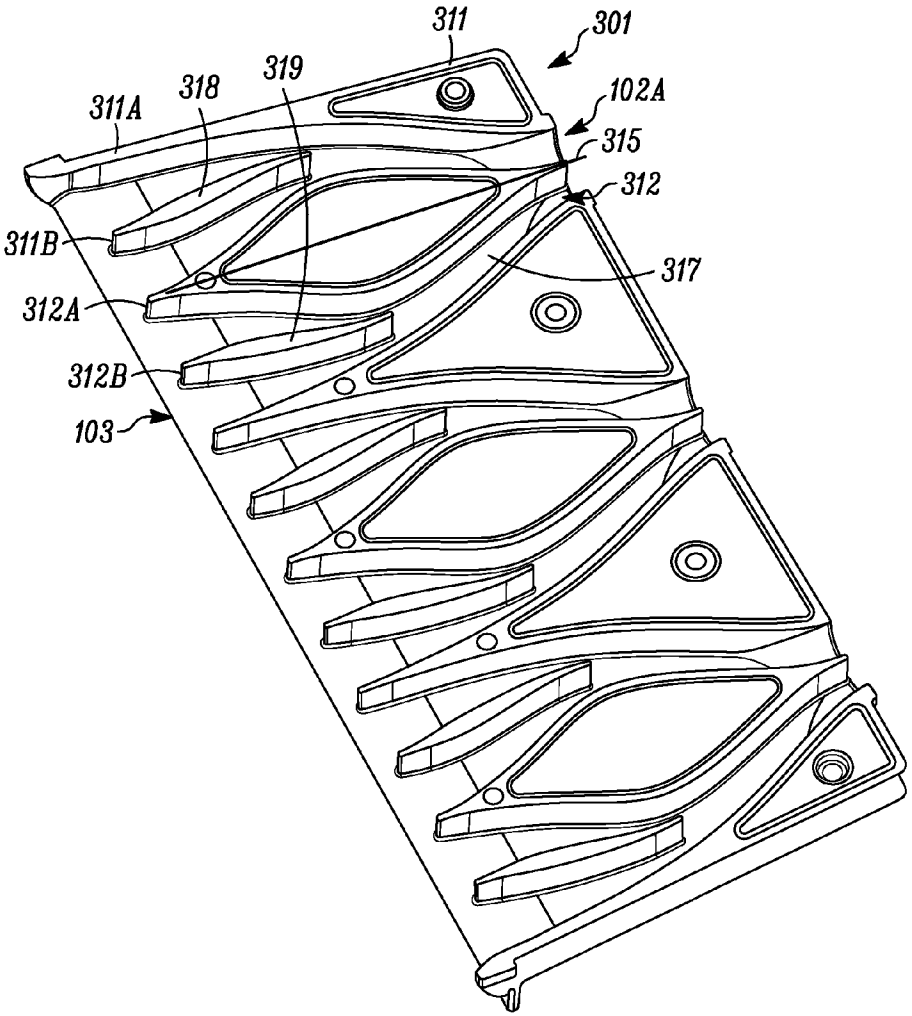
FIG. 3 is an enlarged view of part of the FIG. 2 speaker assembly according to an embodiment.

FIG. 3 shows a simplified waveguide 301 to better illustrate the acoustic paths defined by the waveguide according to various embodiments. Waveguide 301 is simplified relative to the waveguide 101 in that waveguide 301 has fewer acoustic paths than waveguide 101. The acoustic input 102A receives high frequency acoustic signal from a high frequency ("HF") acoustic source. The input 102A has two acoustic paths 311 and 312 at the input 102A. The paths 311 and 312 are minor images of each other about a central plane 315 of the sub-waveguide being described. The paths 311 and 312 are divided at the input by a center vane 317 that includes smooth, continuous and curved walls. The acoustic path 311 is divided into acoustic paths 311A and 311B by a further vane 318, which also has smooth, continuous and curved walls. The acoustic path 312 is divided into acoustic paths 312A and 312B by a further vane 319, which also has smooth, continuous and curved walls. The acoustic paths 311, 312, 311A, 311B, 312A and 312B are have a same length such that the sound wave that enters the input 102A and travels through the acoustic paths 311, 312, 311A, 311B, 312A and 312B emits at the output 103 with the designed properties. In an example, the acoustic paths within a sub-waveguide have the same length that can be different the acoustic paths in other sub-waveguide(s). It will be understood that a modifications to at least one of the acoustic paths such that the sub-waveguide is not symmetrical with respect to its acoustic paths or with respect to other sub-waveguides in the construction shown in FIG. 3.

Figure 4:
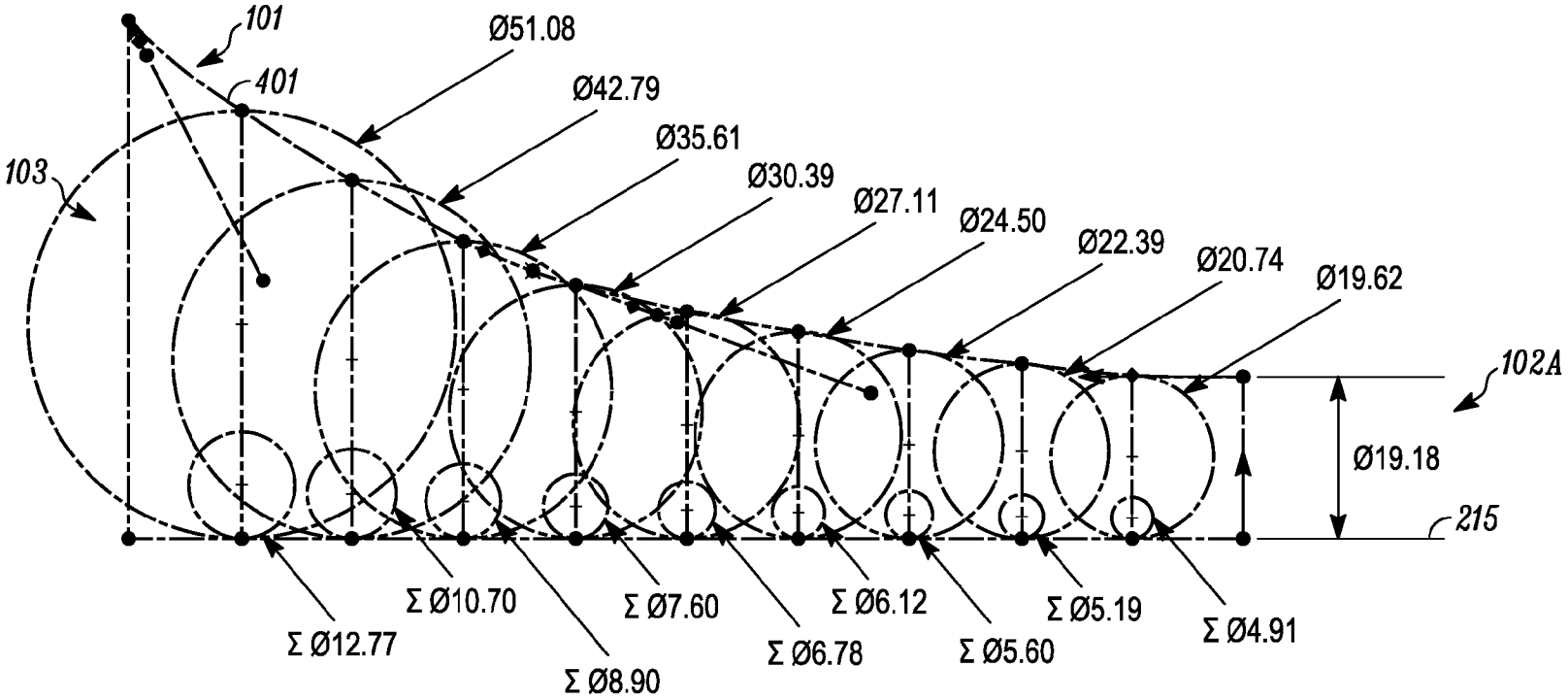
FIG. 4 is a schematic view of a design stage for an acoustic waveguide according to an embodiment.

FIG. 4 shows a design stage of the waveguide 101 that includes an input 102A and an output 103. Only the top half of the waveguide 101 is illustrated for clarity of illustration. The bottom half of the waveguide 101 is a mirror image of the illustrated top half about the center plane 215. The method of designing the waveguide 101 first establishes the input dimension, e.g., the height of the input 102A, and output dimension, e.g., the height of the output 103. The expansion between the input and the output is defined. The dimensions are then reduced in half, which results in a waveguide 101 with a plane of symmetry 215 with a normal contained in a design plane, which is perpendicular to the desired propagation direction, e.g., right to left in FIG. 4. Circles are now defined based on the chosen area expansion and a number of paths to be created, defining the interior height of the sound paths. In an embodiment described herein the waveguide contains eight total sound paths (see FIGS. 2 and 8-9). These circles are defined to have a diameter one-eighth of the area expansion. It will be recognized that any number of paths can be chosen (1, 2, 3, etc. or $2^N$, where N is an integer) to use the present method to design a desired waveguide. In an example, each of the paths created in the waveguide 101 must have a maximum dimension of one half the wavelength ($\lambda/2$) at the highest frequency being propagated through the waveguide 101. However, it is undesirable to have a constant dimension (or cross section) acoustic path as such a path would have poor acoustic loading of the sound source.

The specific embodiment shown in FIG. 4 has a design criterion of eight acoustic paths, with four on one side of the symmetry plane 215 and four on the other side of the symmetry plane 215. A specific example with units will be used to describe the present methodology to design and construct the acoustic paths in the waveguide. It will be recognized that other values can be used to create acoustic paths with different rates of expansion and different sizes throughout the acoustic paths. The outer wall 401 of the waveguide is defined to have the exponential rate of expansion relative to the center plane half of the height of the input 102A is set to be 19.18 mm. The dimension of the waveguide is given at successive locations as the identified by the variable $\theta$. With the variable $\theta$ defined and illustrated, e.g., on a computing system, the dimension of the acoustic paths can be determined. As the FIG. 4 embodiment shows half of the waveguide 101 and there are to be eight total acoustic paths, there are four acoustic paths that must fit into this half of the waveguide 101. The variable $\theta$ is then divided by four to arrive at the value $\Sigma$, which represents the width of an acoustic path at that point in the waveguide. This calculation can be performed by a computing device and displayed for inspection by a designer. For example, at a first position shown in FIG. 4, at a location greater than 80 mm, from the input 102A, the waveguide has a half height of 19.62 mm (θ), which results in an acoustic path with a height of 4.91 mm (Σ). At the last calculation, the waveguide has a half height of 51.08 mm, which results in an acoustic path height of 12.77 mm (Σ). As a design rule, the acoustic paths increase in dimension (waveguide dimension)/N, wherein N is the number of acoustic paths.

Figure 10:
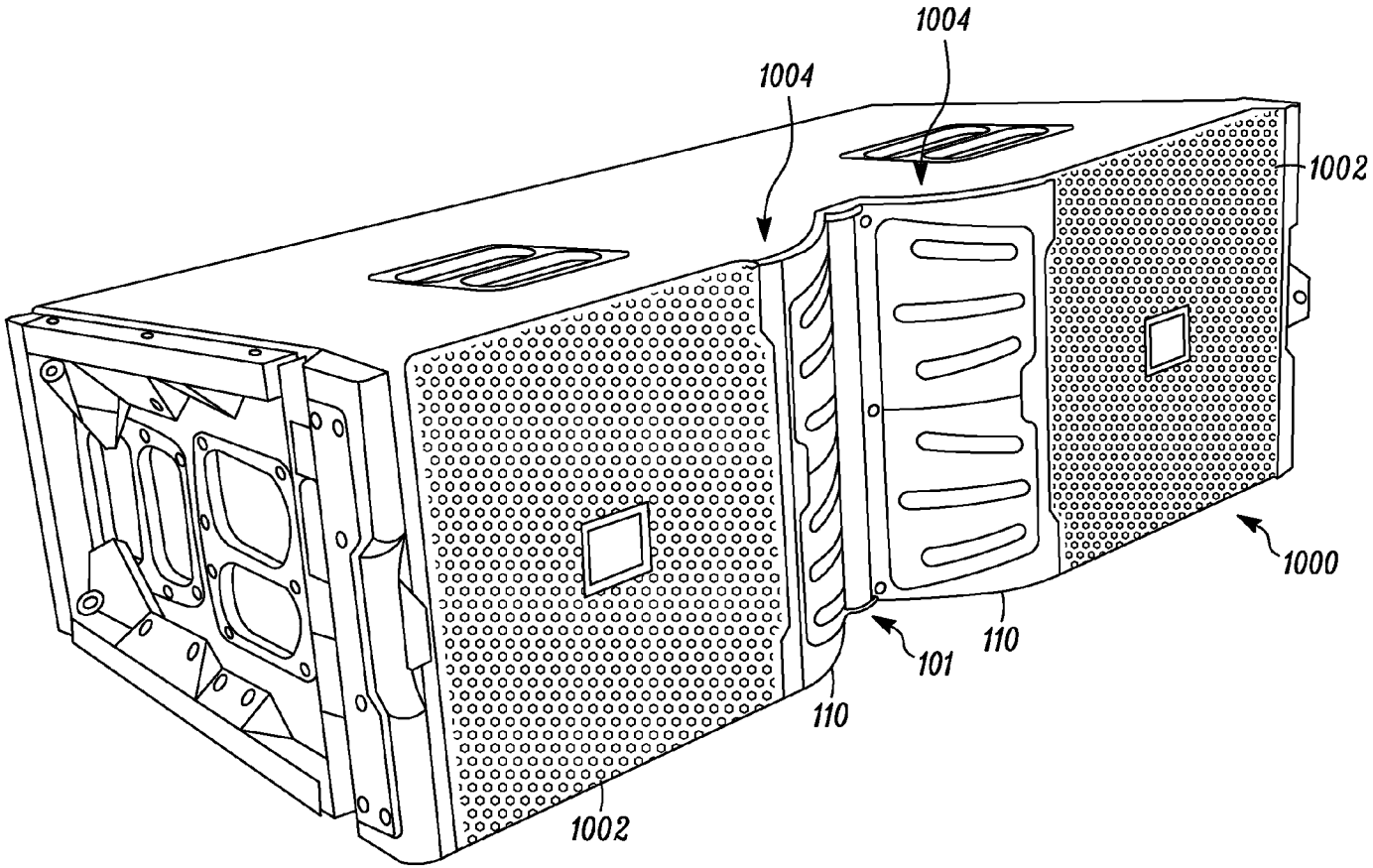
FIG. 10 is a view of a line array element according to an embodiment.
Figure 11:
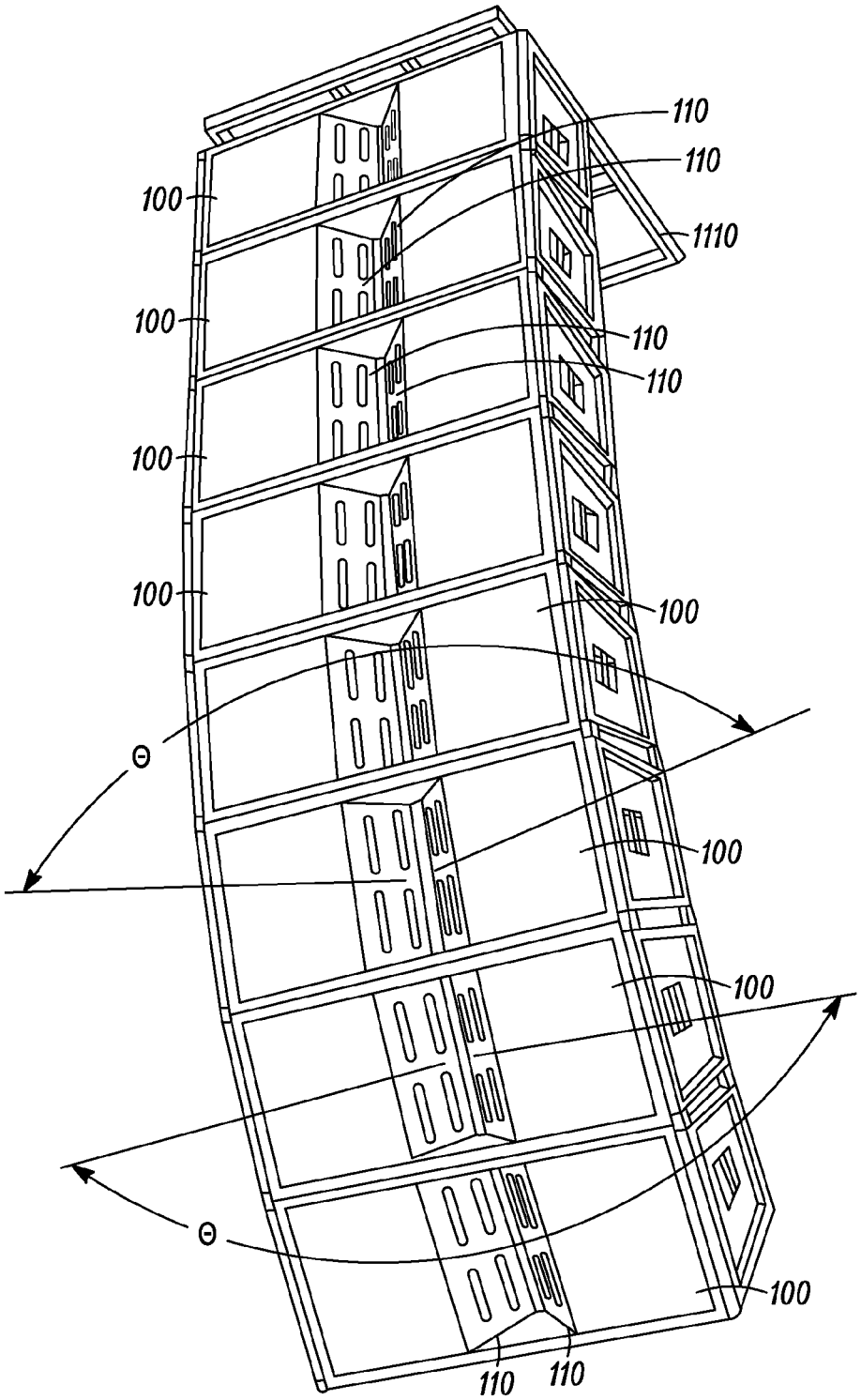
FIG. 11 is a view of a line array of speakers according to an embodiment.

The present disclosure modifies the acoustic paths in height as modifying in height is best for using the waveguide in a vertical mounting in a speaker, e.g., speaker 100 (FIG. 1), speaker 1000 (FIG. 10) and vertical speaker array 1100 (FIG. 11). However, it is within the scope of the present disclosure to also modify the acoustic paths in a width as opposed to height.

The present disclosure further shows the acoustic paths to have a polygon cross section, more specifically a rectangular cross section. This cross section increase in size exponentially from the input to the output in at least one dimension. In various embodiments, the acoustic paths only increase exponentially in one dimension, e.g., either height or width. While the present example shows a single dimension for each acoustic path, it will be within the scope of the present disclosure to have at least one acoustic path as having a different dimension that the other acoustic paths. However, such a path may also increase in size from the input to the output.

Figure 5:
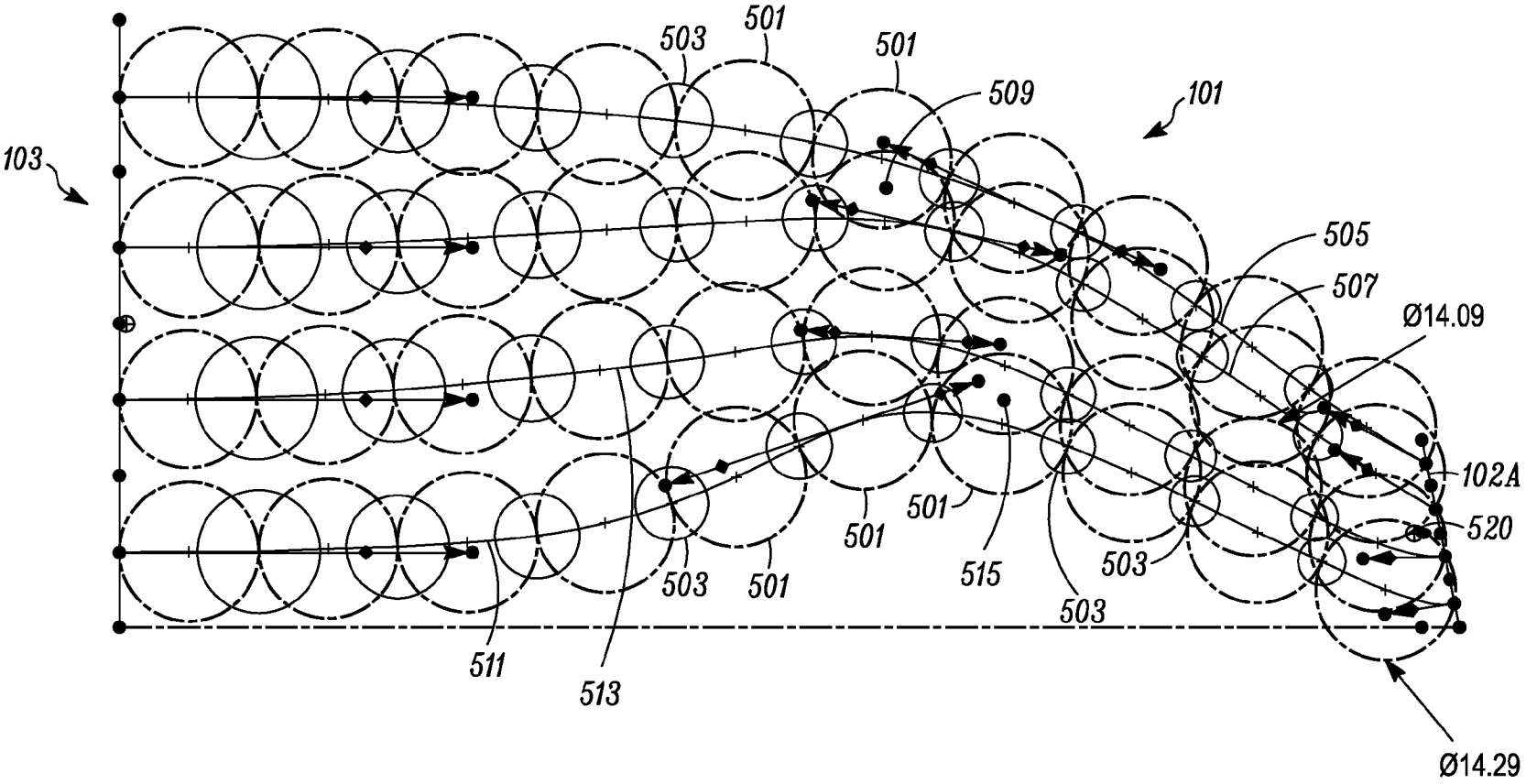
FIG. 5 is a schematic view of a design stage for an acoustic waveguide according to an embodiment.

FIG. 5 shows a further design stage for the waveguide 101 in which spline curves are laid out to show the center of the acoustic paths that will form the waveguide 101. The spline curves determine the length of the acoustic paths. Each path is designed to carry all frequencies that are input into the acoustic path. The dashed circles 501 show a representation of a dimension of an acoustic path. The dashed circles are a design tool to position the acoustic path and create the spline lengths of the acoustic paths to be equal. In an example, state the spline lengths are substantially equal in arc length. The solid circles 503 represent the height of an individual acoustic path, which must increase in height from the input 102A to the output 103. Note that this design stage is limited by the size of the input and output from FIG. 4. That is, the input 102A has the same height in both FIGS. 4 and 5. The output 103 has the same height in both FIGS. 4 and 5. When the solid circles 503 no longer touch or overlap, then the acoustic path must be separated from another path. As shown in the top two acoustic paths, 505, 507, this occurs at about point 509. Here, the two acoustic paths 505, 507 must be mechanically separated by a wall, e.g., a vane as described herein. The acoustic paths 511, 513 must be separated at about point 515. These points are readily visualized by the separation of the solid circles 503, representing the heights of the acoustic paths 505 and 507 or 511 and 513. It is further recognized that the top pair of acoustic paths 505, 507 must be mechanically separated from the bottom pair of acoustic paths 511, 513 essentially immediately at the input 102A, for example at point 520. It will be recognized that the splines that define the acoustic paths 505, 507, 511, 513 are smooth curves without discrete discontinuities or corners. Moreover, the bends in the splines and lack of discrete discontinuities or corners operates to reduce and essentially eliminate reflections of the acoustic signal in the acoustic paths.

At this design stage the acoustic paths 505, 507, 511 and 513 may be modified to achieve desired acoustic effects on the signals to be propagated through the paths. Multiple paths are created in the design plane shown in FIG. 5 to link the input and output of the device with equal length paths. For example, the path 511 in the nearest the center plane must curve more than the other paths 505, 507 and 513 to ensure the equal lengths for the paths. In an embodiment, the separate sound paths can have unequal length to allow a sound path to be longer or shorter than other sound paths within the waveguide. This can compensate for sound sources with non-isophase wave fronts (unequal time/phase). Additionally, sound paths of varying widths can be imagined to compensate for sound sources with non-isobel wave fronts (unequal amplitude).

Figure 6:
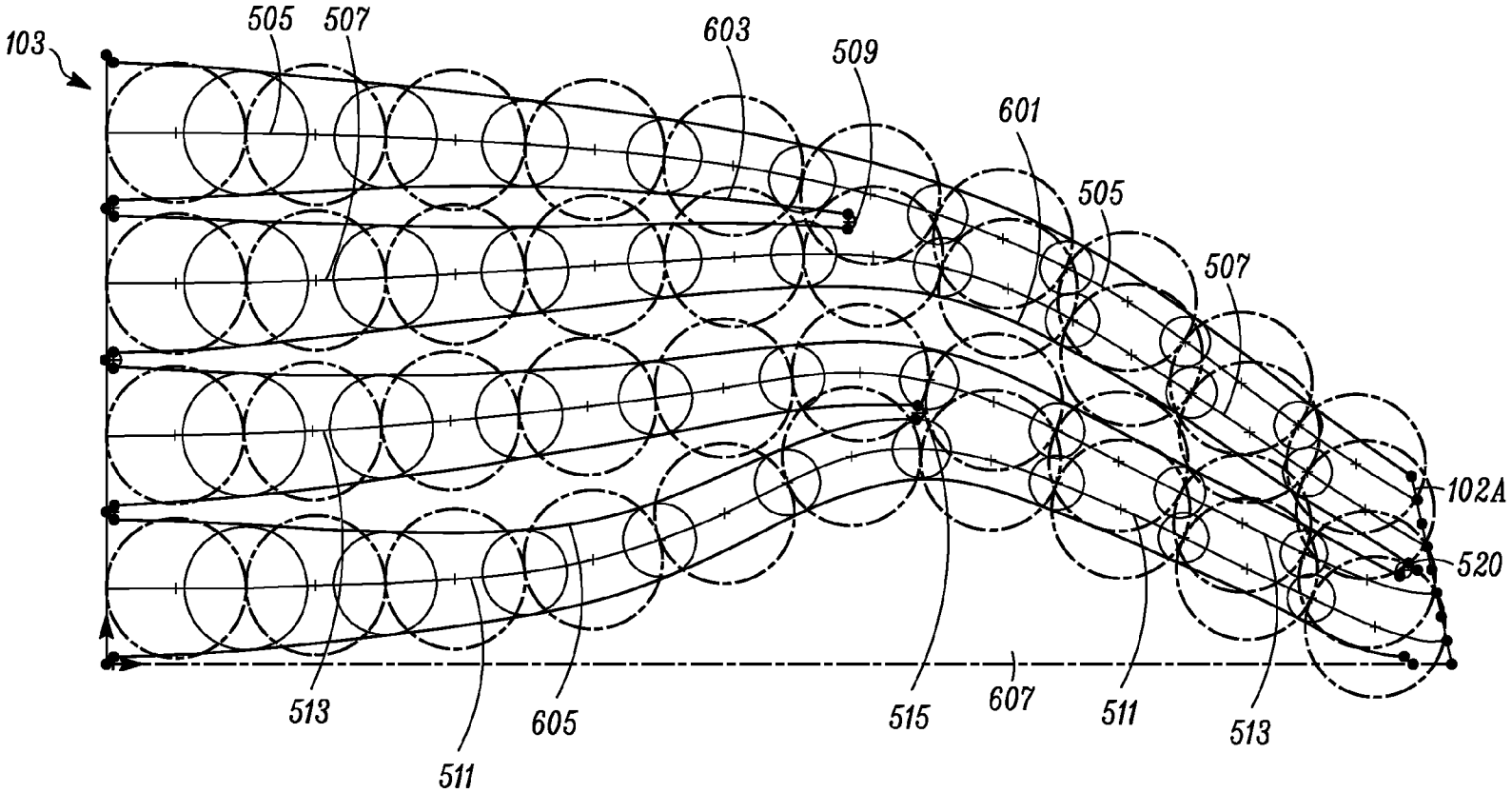
FIG. 6 is a schematic view of a design stage for an acoustic waveguide according to an embodiment.

FIG. 6 shows a further design stage for the waveguide 101 in which the mechanical separation structures, i.e., vanes 601, 603, are added to the waveguide to separate the acoustic paths at the designed locations, here, points 509, 515 and 520 as determined in the prior design stage (FIG. 5). The first vane 601 begins at point 520 and separates the top acoustic path pair 505, 507 from the bottom acoustic path pair 511, 513 and ends at the output 103. The vane 601 separates the top acoustic path pair 505, 507 from the bottom acoustic path pair 511, 513 throughout the length of the waveguide. Hence the acoustic signals in the top acoustic path pair 505, 507 from the bottom acoustic path pair 511, 513 are prevented from recombining until the outlet 103. The leading part of the vane 601 at point 520 is smooth and rounded to prevent reflections of the acoustic wave input into the waveguide 101. The vane 601 has smooth walls that define one wall of the acoustic path 507 and one wall of the acoustic path 513. A vane 603 separates the top acoustic path pair 505, 507 at point 509. Hence the acoustic signals in the top acoustic path pair 505, 507 are now separate and cannot recombine until the outlet 103. The leading edge of the vane 603 at point 509 is smooth and rounded to prevent reflections of the acoustic wave at point 509. The vane 603 has smooth walls that define one wall of the acoustic path 505 and one wall of the acoustic path 507. A vane 605 separates the bottom acoustic path pair 511, 513 at point 515. Hence the acoustic signals in the bottom acoustic path pair 511, 513 are now separate and cannot recombine until the outlet 103. The leading edge of the vane 605 at point 515 is smooth and rounded to prevent reflections of the acoustic wave at point 515. The vane 605 has smooth walls that define one wall of the acoustic path 511 and one wall of the acoustic path 513. The vanes 601, 603 and 605 can have varying thickness to control the dimension of the adjacent acoustic paths. None of the acoustic paths exceed the maximum dimension as defined design stage shown in FIG. 4. In the specific example, none of the acoustic paths 505, 507, 511 or 513 exceed 12.77 (Σ).

The area expansion circles are spaced evenly upon the acoustic paths to define the interior width of the acoustic paths. These can be used to define any interior and exterior walls used to divide the acoustic paths. The walls are intended to maintain a sound path width less than one half the wavelength of the maximum operating frequency. In an example, the maximum frequency is about 16 kHz, so the maximum sound path width is about 10 mm. The sound paths are left combined from the input of the waveguide until the interior width of the acoustic path reaches the maximum acoustic path width. The acoustic paths are then split and continue to expand until the maximum acoustic path width is exceeded again, or until the output of the waveguide is reached.

It is also desirable to have the sound paths exit normal to the intended wavefront. The last section of the device then is constrained to force the paths to be substantially parallel with the intended direction of projection.

Figure 7:
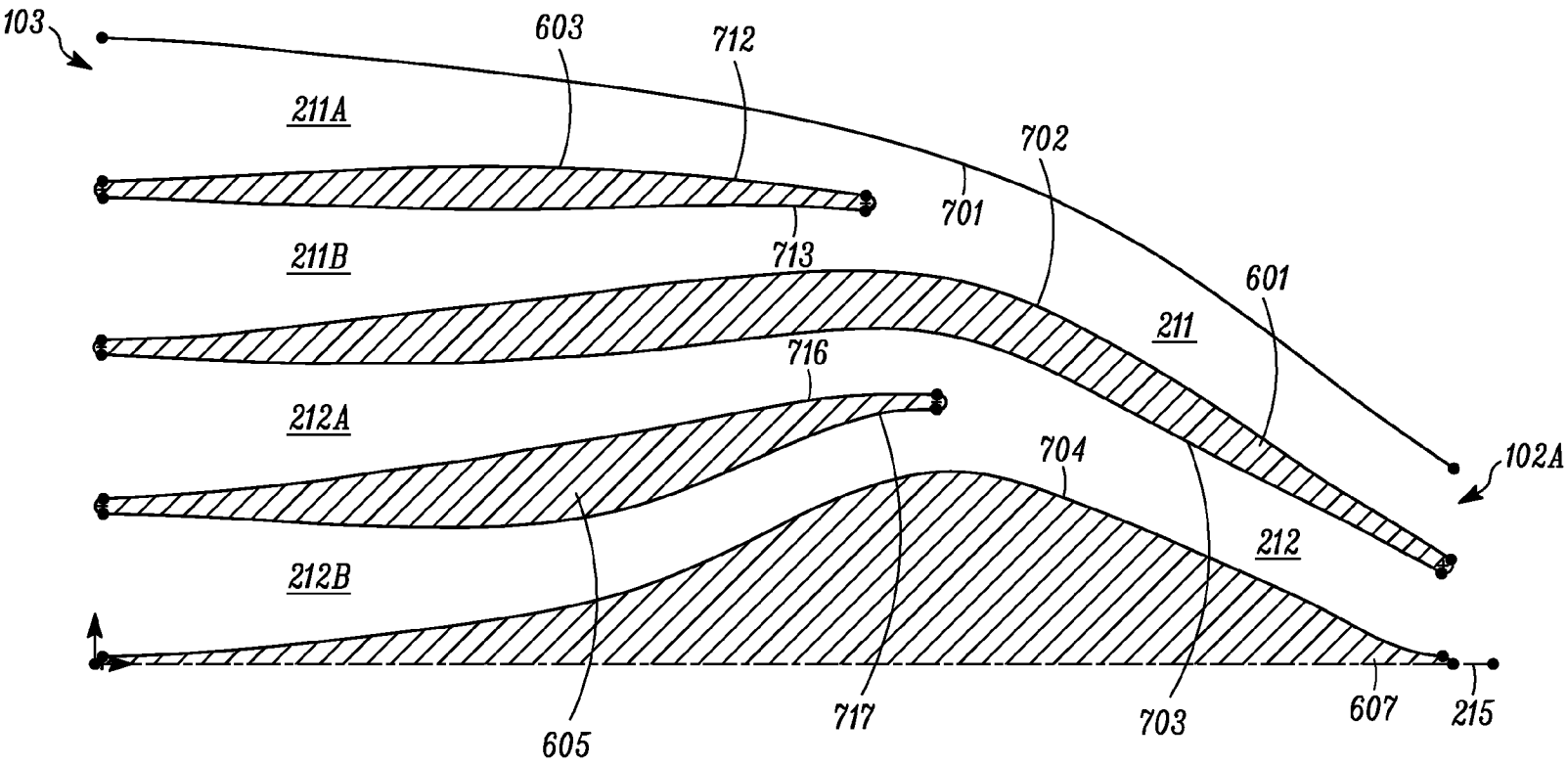
FIG. 7 is a schematic view of a design stage of an acoustic waveguide according to an embodiment.

FIG. 7 shows the relationship of the design stages of FIGS. 4-6 to the devices shown in FIGS. 1-3. The vanes 601, 603, 605 and 607 define various walls that in turn define the acoustic paths 211, 212 and 211A, 211B, 212A, 212B. In an example, the vanes 601, 603, 605 and 607 can have solid bodies and be formed from a polymer, a metal or other sufficiently rigid material that can mold the continuous, smooth walls required. The outer wall 701 defines the uppermost surface of an acoustic path 211 and 211A. It will be recognized that acoustic path 211 includes both the acoustic paths 505 and 507. However, as the acoustic paths 505, 507 are combined in path 211, there is a single open path. The vane 601 has an upper surface 702 that with wall 701 defines the acoustic path 211. The vane 603 has an upper surface 712 and a lower surface 713. The upper surface 712 and wall 701 define the acoustic path 211A. The lower surface 713 and upper surface 702 of vane 601 define the acoustic path 211B. The vane 601 has a lower surface 703 that with the upper surface 704 of the bottom vane 607 defines the acoustic path 212. The vane 605 has an upper surface 716 and a lower surface 717. The upper surface 716 and bottom surface 703 of vane 601 define the acoustic path 212A. The lower surface 717 and upper surface 704 of vane 607 define the acoustic path 212B. All of the surfaces that define the acoustic paths are smooth and not discontinuous. In an example, at least one acoustic path is asymmetrical about a center plane or with respect to other acoustic paths.

Figure 8:
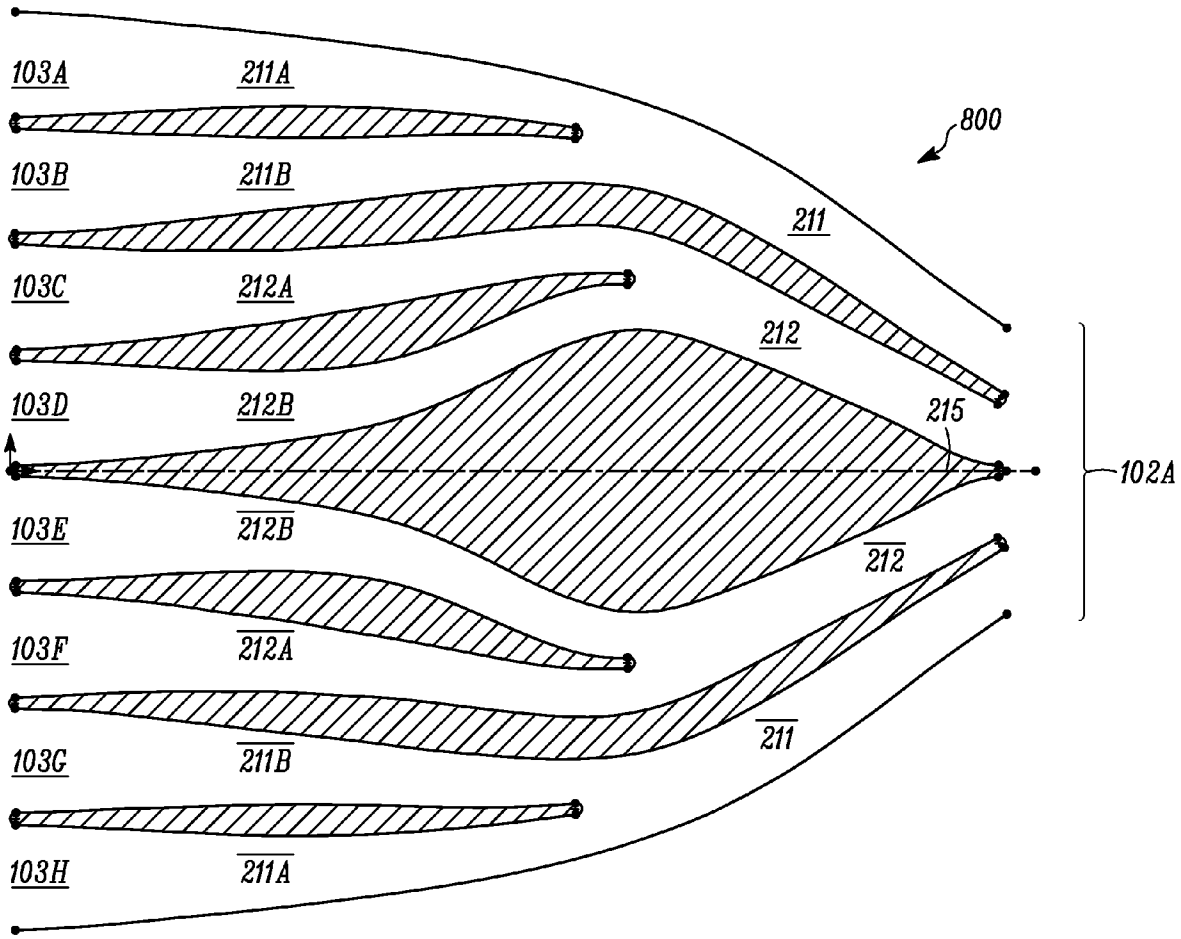
FIG. 8 is a schematic view of a design stage of an acoustic waveguide according to an embodiment.

FIG. 8 shows a complete sub-waveguide 800 that was designed using the methods of FIGS. 4-6. As can be seen in drawings, FIG. 8 is the same as FIG. 7 but includes the bottom half of the sub-waveguide. The bottom half of this sub-waveguide is a mirror image of FIG. 7 about the plane of symmetry 215. The acoustic paths of bottom half are number the same as in FIG. 7 but with the numbers including a bar there over to indicate that it is the same but reflected into the bottom half. The output of each acoustic path is designated by 103A-103H. As described in the design embodiment herein, there are eight acoustic paths that result in eight distinct outputs 103A-103H.

Figure 9:
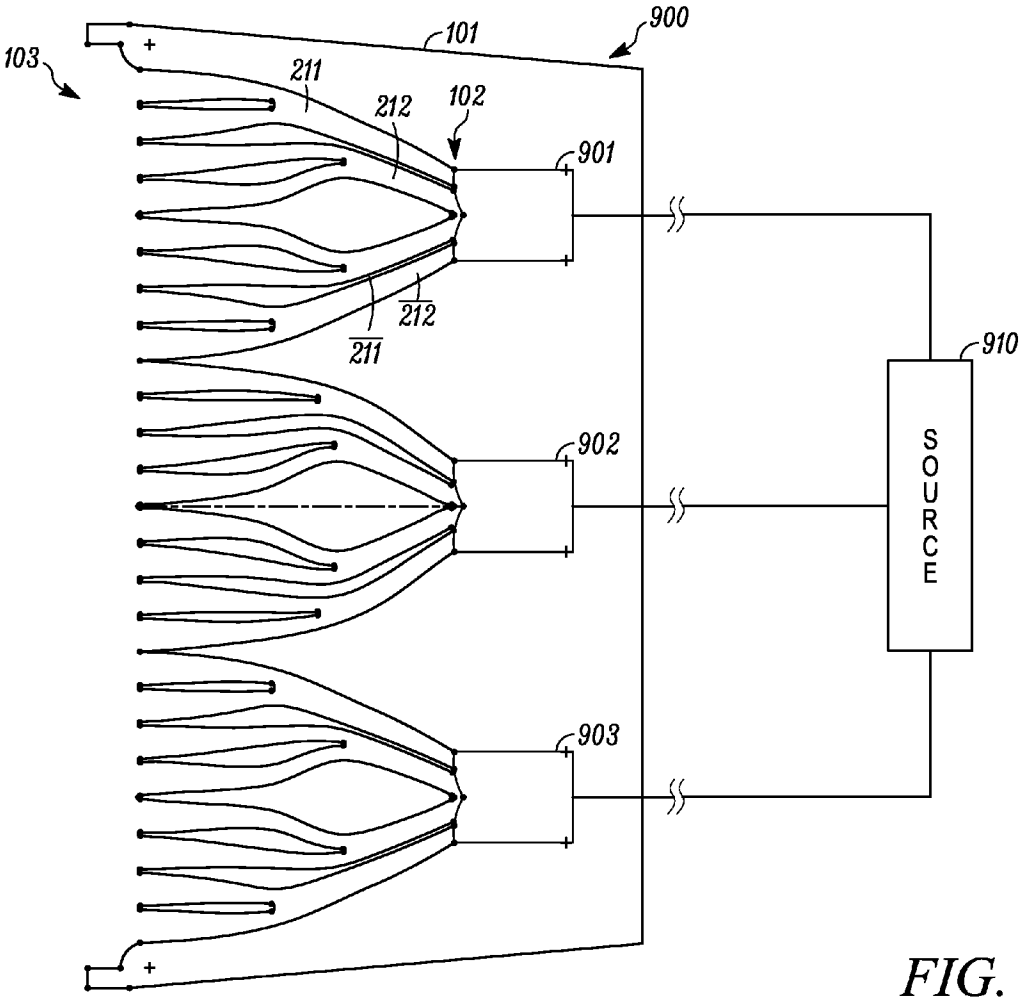
FIG. 9 is a view of a speaker assembly according to an embodiment.

FIG. 9 shows a schematic view of a high frequency speaker assembly 900 with a waveguide 101 that receives acoustic signals from drivers 9001-903. The drivers 901-903 receive electrical signals from a source 910, for example, power amplifiers, sound boards, musical instruments, etc. The drivers 901-903 convert the electrical signals to acoustic signals that are input into the waveguide 101.

FIG. 10 shows a line array element 1000 in which the high frequency waveguide 101 is positioned between the sound integrators 110. The low frequency sound sources 1002 may be positioned to the sides of the sound integrators 110. The sound integrators 110 may provide a substantially solid boundary for the high frequency sound waves produced by the high frequency waveguide 101 and may allow mid-range sound waves from the mid-range sound sources 1004 to pass through. The sound integrator 110 may include slots 115 or other openings that allow the mid-range sound from sources 1004 to pass through the sound integrators 110. In another example, the sound integrators 110 may include no openings. The high frequency sound waves pass along a substantially smooth surface of the integrators 110 to integrate the sound waves radiating from both the high and mid-range frequency sound sources for better sound control and to minimize distortion of the high frequency sound wave front shapes. The sound integrator 110 may also act as a volume displacement device to improve loading and efficiency of the mid-range frequency elements. In an example, a line array element can include the sound integrators that have a curvature radius of ¼ the highest frequency of the sound signal traveling in the acoustic waveguide.

The high frequency sound sources, which can include the waveguide 101 and the drivers, generate high frequency energy or sound waves, which propagate across the sound integrators 110. The surfaces of the sound integrators 110 are angled relative to each other with the exception of a leading section that is proximal to the waveguide outputs 103

FIG. 11 shows a speaker array 1100 of speakers 100. The loudspeakers 100 may be arranged vertically on top of another or hung from an overhead support structure 1110 within a venue. The arrangement shown in FIG. 11 is a speaker array with the high frequency waveguides 101 of the speakers being aligned with each other along a vertical or a vertical arc. The loudspeakers 100 can be suspended above an audience to form vertical lines of transducer arrays within the bass, mid-range and treble band (high frequency) passes. The speaker array may be curved to increase vertical angular coverage and to provide better control of the radiated sound. The sound radiating from the array may be further controlled by utilizing sound integrators 110 to control the direction angle θ, or angular coverage, of the sound radiated from one or more of the loudspeaker enclosures. The controlled direction may include the horizontal direction, and can also include any other direction such as the vertical direction or an oblique direction. The angular coverage may vary from loudspeaker 100 to loudspeaker 100 within the array 1100. As such, the loudspeakers 100 arranged near a top of the array may provide one coverage angle and the loudspeakers 100 arranged near a bottom of the array may provide a different coverage angle. Additional disclosure with regard to speaker arrays can be found in U.S. Pat. Nos. 7,324,654 and 7,333,626, which are assigned to the current assignee and are incorporated herein by reference for any purpose.

It is believed that the present methods and structures described herein improve on existing technology in when combining multiple sound sources, emitting the same acoustical content, to 1) evenly distribute sound on a listening plane 2) reduce excess sound emitted outside the listening plane (i.e. sidelobes). Moreover, the present disclosure further describes a method to design a structure that will allow the loudspeaker device to maintain a wavefront curvature of less than one quarter the wavelength of the maximum operating frequency. This will improve the ability of the loudspeaker to emit sound to the listening plane and reject noise going outside the listening plane. In addition, the present methodology allows the designer to specify the area expansion rate from the input of the structure to the exit of the structure. Thus the designer can specify the desired exponential rate of area expansion. The present methodology and structures also gives the designer a method for designing a device which emits a chosen non-isophase, non-isobel wavefront.

The present disclosure refers to "high frequency" for use in acoustics and the design of a waveguide. As used herein high frequency may refer to high frequency sounds as heard by a human, e.g., in music or in other listening. High frequency can be greater than 1 kHz, 2 kHz, 3 kHz or 5 kHz. In the case of human hearing the top end of high frequency is about 20 kHz, based on the typically accepted human hearing range of between 20 Hz and 20 kHz. High frequency in some specialty cases can go up to 100 kHz. However, for purposes of loudspeakers for presenting acoustic content to people such a high frequency, 100 kHz, is not required.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A high frequency waveguide comprising:

an acoustic input to receive an audio input signal from a high frequency driver;

an acoustic output to broadcast sound; and a plurality of acoustic paths extending from the input to the output, wherein a first path of acoustic paths is divided into two paths intermediate the acoustic input and the acoustic output when a width of the first path is greater than ½ wavelength of a highest frequency at the input.

2. The waveguide of claim 1, wherein each of the plurality of acoustic paths carries across all frequencies from the high frequency driver.

3. The waveguide of claim 1, wherein the paths each have a first port receiving audio and a second port outputting audio, and the paths enlarge from the first port to the second port.

4. The waveguide of claim 1, wherein outer walls define cross sectional area of the loudspeaker and exponentially diverge from the acoustic input to the acoustic output.

5. The waveguide of claim 1, wherein the acoustic paths do not recombine until the acoustic output.

6. The waveguide of claim 1, wherein the acoustic paths have a same length from the acoustic input to the acoustic output.

7. The waveguide of claim 1, wherein the acoustic paths are defined by smooth walls.

8. The waveguide of claim 1, wherein the acoustics paths are mirrored about a central plane symmetry.

9. The waveguide of claim 8, wherein at least one of the acoustic paths is asymmetrical to another acoustic path about the central plane.

10. The waveguide of claim 1, wherein the acoustic paths have outlets at the acoustic output oriented to achieve a desired wavefront curvature.

11. The waveguide of claim 1, wherein the acoustic paths have unequal lengths to compensate for a non-isophase input signal at the acoustic input.

12. The waveguide of claim 1, wherein the acoustic paths have unequal widths to compensate for a non-isobel input signal at the acoustic input.

13. The waveguide of claim 1, wherein the acoustic paths are curved and defined by smooth walls.

14. The waveguide of claim 1, wherein at least one of the acoustic paths is asymmetrical with respect to another acoustic path.

15. A speaker line array element, comprising:

an elongate, high frequency waveguide including:

at least two high frequency drivers;

at least two acoustic inputs to receive an audio input signal from the high frequency drivers;

an acoustic output to broadcast sound; and at least two sets of a plurality of acoustic paths extending from the inputs to the output, wherein a first path of acoustic paths of each set is divided intermediate the acoustic input and the acoustic output into two paths when a width of the first path is greater than ½ wavelength of a highest frequency at the inputs;

a first sound integrator extending outwardly from a first side of the acoustic output, the first sound integrator including a plurality of first slots;

a second sound integrator extending outwardly from a second side of the acoustic output, the second sound integrator including a plurality of second slots;

a first mid-range speaker behind the first sound integrator to output a mid-range acoustic signal through the first slots; and a second mid-range speaker behind the second sound integrator to output a mid-range acoustic through the second slots.

16. The element of claim 15, wherein each of the plurality of acoustic paths carries across all frequencies from the high frequency driver;

wherein the paths each have a first port receiving audio and a second port outputting audio, and the paths enlarge from the first port to the second port;

wherein outer walls define cross sectional area of the waveguide and exponentially diverge from the acoustic input to the acoustic output; and wherein the acoustic paths do not recombine until the acoustic output.

17. The element of claim 16, wherein the acoustic paths have a same length from the acoustic input to the acoustic output.

18. The element of claim 16, wherein one of a set of acoustic paths receives an acoustic signal from one of the drivers and the one set of acoustics paths is mirrored about a central plane of symmetry.

19. A method for a high frequency waveguide comprising:

determining a rate of expansion for a high frequency waveguide;

determining a number of acoustical paths for the waveguide with a dimension of the acoustical paths to be no greater than ½ wavelength of a highest frequency at an input;

laying the acoustical paths in the waveguide; and when any acoustical path has a dimension greater than ½ wavelength of a highest frequency, inserting a dividing structure to divide the acoustic paths intermediate an acoustic input and an acoustic output to maintain the limit on the dimension.

20. The method of claim 19, wherein each of the steps is performed for a half of the waveguide and then a mirror image of the half of the waveguide is constructed about a line of symmetry.

21. The method of claim 19, wherein the rate of expansion is exponential.

22. The method of claim 19, wherein the acoustic paths have outlets at the acoustic output oriented to achieve a desired wavefront curvature;

wherein laying the acoustical paths includes compensating for a non-isophase input signal at the acoustic input by adjusting the acoustic paths to have unequal lengths; and wherein laying the acoustical paths includes compensating for a non-isobel input signal at the acoustic input by adjusting the acoustic paths to have unequal widths.

* * * * *